US011359372B2

(12) United States Patent
Hall et al.

(10) Patent No.: US 11,359,372 B2
(45) Date of Patent: Jun. 14, 2022

(54) SYSTEMS FOR REVERSIBLY DIVIDING A SPACE

(71) Applicant: Hall Labs LLC, Provo, UT (US)

(72) Inventors: David R Hall, Provo, UT (US); Benjamin Jensen, Orem, UT (US); Alexa Goodman, Provo, UT (US); Jeffrey Knighton, Provo, UT (US); Matthew Raun, Provo, UT (US); Scott Tew, Provo, UT (US); Nathan Cowley, Provo, UT (US)

(73) Assignee: Hall Labs LLC, Provo, UT (US)

( * ) Notice: Subject to any disclaimer, the term of this patent is extended or adjusted under 35 U.S.C. 154(b) by 183 days.

(21) Appl. No.: 16/447,956

(22) Filed: Jun. 20, 2019

(65) Prior Publication Data

US 2020/0399895 A1 Dec. 24, 2020

(51) Int. Cl.

| | |
|---|---|
| ***E04B 2/82*** | (2006.01) |
| ***E05D 15/18*** | (2006.01) |
| ***E04B 2/74*** | (2006.01) |
| ***E05F 15/67*** | (2015.01) |
| *E05F 15/60* | (2015.01) |
| *E05D 15/22* | (2006.01) |

(52) U.S. Cl.

CPC ..... *E04B 2/827* (2013.01); *E04B 2/7401* (2013.01); *E04B 2/7403* (2013.01); *E04B 2/7405* (2013.01); *E05D 15/18* (2013.01); *E05F 15/67* (2015.01); *E04B 2002/7481* (2013.01); *E05D 2015/225* (2013.01); *E05F 15/60* (2015.01); *E05Y 2900/142* (2013.01)

(58) Field of Classification Search

CPC ..... E04B 2/827; E04B 2/7405; E04B 2/7403; E04B 2/7401; E04B 2002/7481; E04B 2/828; E05D 15/18; E05D 2015/225; E05D 15/0608; E05D 15/165; E05D 15/0652; E05D 15/08; E05F 15/60; E05F 2002/7481; E05F 15/67; E05Y 2900/142; E05Y 2201/684; E06B 9/0676

See application file for complete search history.

(56) References Cited

U.S. PATENT DOCUMENTS 1,238,704 A * 8/1917 Wendelken ..... E06B 3/44 49/125
1,975,187 A * 10/1934 Aberle ..... E06B 3/5063 49/128
2,992,460 A * 7/1961 Hentges ..... E06B 3/4672 49/130
3,052,000 A * 9/1962 Ferrett ..... E04B 2/827 52/64
3,334,375 A * 8/1967 Hubbard ..... E05D 15/0608 16/97
3,491,400 A * 1/1970 Hubbard ..... E06B 3/924 16/96 R
3,654,732 A * 4/1972 Schacht ..... E06B 3/924 49/127

(Continued)

*Primary Examiner* — Brent W Herring

(57) ABSTRACT

A system for reversibly dividing a space is disclosed. Independent panels, with track followers attached to both narrow sides, move along parallel tracks. The panels start in an overhead storage space. The tracks are shaped such that as the panels move from the storage space into the space to be divided, one panel stops higher and the next panel slides down and then under the first panel. These panels preferably form a single-plane divider in the space.

20 Claims, 9 Drawing Sheets

(56) References Cited

U.S. PATENT DOCUMENTS 4,122,633 A * 10/1978 Holdiman ..... E06B 3/302 49/501
4,662,420 A * 5/1987 Hirao ..... E06B 9/0638 160/133
4,760,872 A * 8/1988 Hale, Jr. ..... E06B 7/32 160/180
5,088,236 A * 2/1992 Karhu ..... E05D 15/0608 49/127
5,230,123 A * 7/1993 Williams ..... E05D 15/0613 16/95 R
6,286,258 B1 * 9/2001 Bischof ..... E05D 15/0608 49/127
6,840,009 B2 * 1/2005 Ronay ..... E05D 15/0608 49/127
7,950,439 B2 * 5/2011 Anderson ..... E05D 15/58 160/211
8,113,607 B2 * 2/2012 Slager ..... E05B 65/0882 312/304
8,375,645 B2 * 2/2013 Iwauchi ..... E05D 15/1042 52/29
8,375,646 B2 * 2/2013 Newkirk ..... A61G 12/005 52/29
8,627,621 B2 * 1/2014 Liebscher ..... E05D 15/0608 52/238.1
8,631,605 B1 * 1/2014 Davenport ..... E06B 7/32 49/169
8,955,260 B2 * 2/2015 Newkirk ..... A61G 12/005 52/29
8,984,810 B2 * 3/2015 Bortoluzzi ..... E05D 15/0678 49/213
9,228,343 B2 * 1/2016 Hilliaho ..... E06B 3/924
9,470,028 B2 * 10/2016 Header ..... E05D 15/1065
9,637,961 B2 * 5/2017 Header ..... E05D 15/10
10,077,588 B1 * 9/2018 Header ..... E05D 15/063
10,309,138 B2 * 6/2019 Header ..... E05D 15/0608
11,002,064 B2 * 5/2021 Hall ..... E04B 1/34363
2003/0150165 A1 * 8/2003 Ronay ..... E05D 15/1042 49/127
2003/0226315 A1 * 12/2003 Haab ..... E06B 3/5436 49/127
2004/0003556 A1 * 1/2004 Zerbst ..... E05D 15/0643 52/220.7
2006/0225357 A1 * 10/2006 Bortoluzzi ..... E05D 15/1042 49/213
2010/0205865 A1 * 8/2010 Iwauchi ..... E05D 15/1042 49/404
2012/0144627 A1 * 6/2012 Liebscher ..... E05D 15/0608 16/96 R
2015/0284949 A1 * 10/2015 Hilliaho ..... E04B 2/72 52/204.1
2016/0114659 A1 * 4/2016 Maruyama ..... E05D 15/0608 49/164
2017/0211311 A1 * 7/2017 Jang ..... E05D 15/20
2018/0363345 A1 * 12/2018 Header ..... E04B 2/827
2021/0032856 A1 * 2/2021 Hall ..... E04B 1/34363

* cited by examiner

SYSTEMS FOR REVERSIBLY DIVIDING A SPACE

TECHNICAL FIELD

The systems described herein relate generally to dividing spaces.

BACKGROUND

Modular office and home spaces are becoming more and more common. These spaces are convertible between different uses. A major challenge for modular spaces is separation of the spaces. Systems and devices for effectively separating spaces are required.

SUMMARY

In a first aspect, the disclosure provides a system for reversibly dividing a space. A first panel has a first track follower and a second track follower attached to opposite, narrow sides of the first panel. A second panel has a third track follower and a fourth track follower attached to opposite, narrow sides of the second panel. A first track and a second track are each on opposite sides of the space to be divided. Each run generally straight and generally vertical. Each has a top at a point overhead and a bottom at a point part-way to a floor of the space. A third and a fourth track each have a vertical portion that is adjacent and runs parallel to the respective first track and second track. Each have a curved portion extending below and across a bottom of the first track and second track. When the space is not being divided, the first and the second panel can be stored in an overhead position. As the first panel is lowered, the first track follower rides in the first track and the second track follower rides in the second track, until the first track follower and the second track follower reach the bottom of the first track and the bottom of the second track, respectively, thus allowing the first panel, when lowered, to divide an upper portion of the space. As the second panel is lowered, the third track follower rides in the third track and the fourth track follower rides in the fourth track. The third track follower and the fourth track follower ride in a generally vertical path, parallel to the first track and the second track, respectively, until the third track follower and the fourth track follower reach the curved portion of the third track and the fourth track, respectively. The third track follower and the fourth track follower follow the third track and the fourth track, respectively, and move below and across the bottom of the first track and the bottom of the second track, respectively, thus allowing the second panel to be aligned with the first panel and divide a lower portion of the space. When deployed, the first panel and the second panel form a divider.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figures 1A, 1B, 1C:
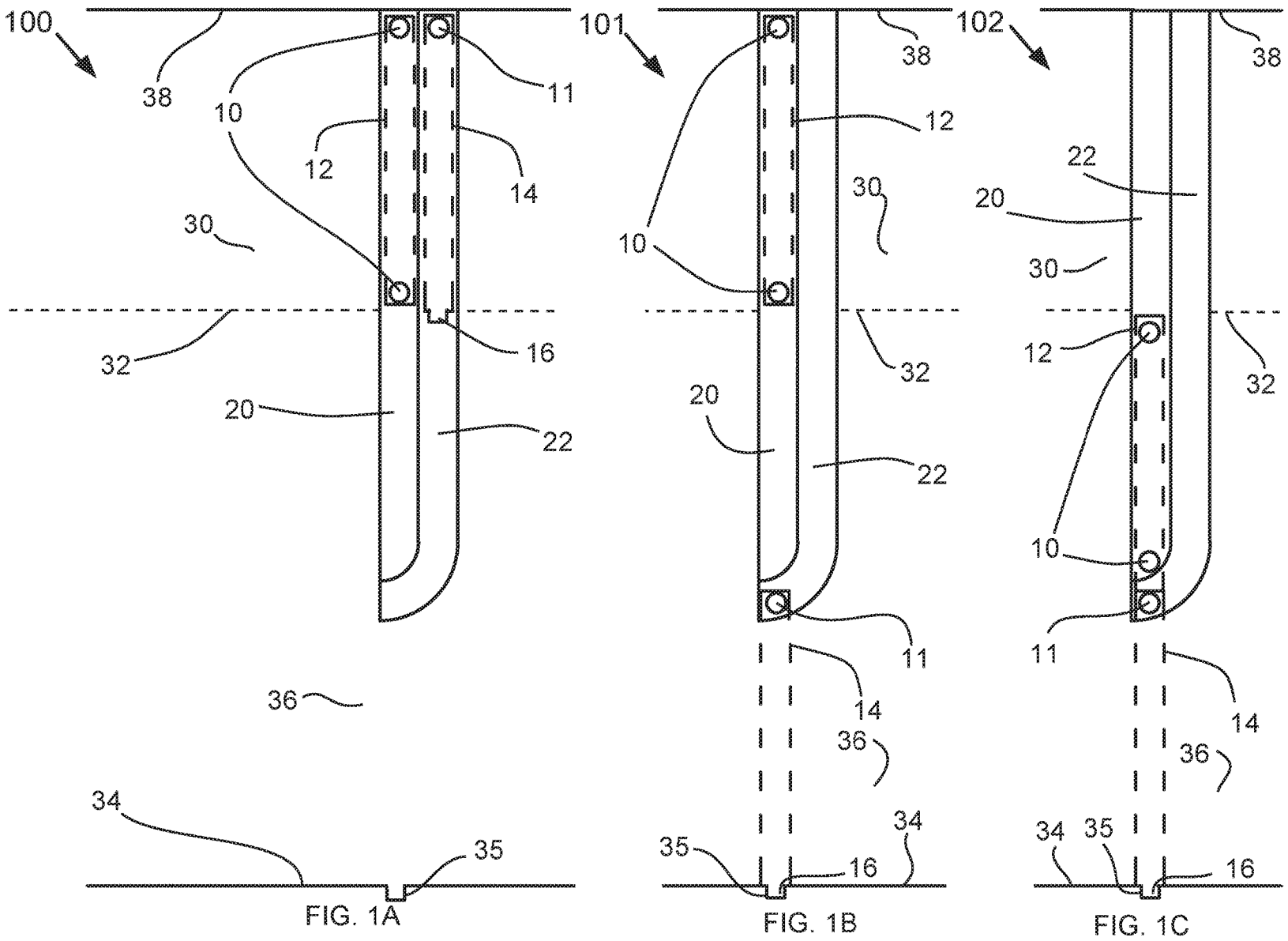
FIGS. 1A-C are cross-sectional, side elevation views of a system to divide a space in retracted, partially-deployed, and fully-deployed states.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "panel" is meant to refer to a cuboid of homogenous or non-homogenous material used as at least a partial divider of a space.

As used herein, "track" is meant to refer to is a strip of material formed so as to allow movement along a given path in a consistent manner.

As used herein, "track follower" is meant to refer to a small piece of material that is attached to a panel and rides in the track. A track follower keeps the panel material in line with the track and forces the panel to follow the path set by the track as the track follower moves along the track.

As used herein, "divider" is meant to refer to the plurality of panels used to the divide the space.

As used herein, "overhead position" is meant to refer to any space above the space to be divided. Preferably, this space will be above the ceiling, but is not restricted to this.

As used herein, "line" is meant to refer to any device or material that is long, cylindrical, thin, flexible, and having a high tensile strength. Preferably, this will be a braided wire, but ropes, cords, string, twine, cable, strand, chains and combinations thereof may be used as well.

As used herein, "sound dampeners" is meant to refer to a passive material or an active device used to diminish the sound transfer through the divider.

As used herein, "gasket" is meant to refer to any material used to make a seal between two abutting surfaces. Gaskets may also be sound dampeners.

As used herein, "locking mechanism" is meant to refer to any mechanism designed to reversibly hold a plurality of objects together to prevent the dislocation of their current positions.

The disclosed invention consists of a divider being made up of independent panels, where each panel is mounted on independent, parallel tracks. The top-most panel is on a track that is generally straight. The second, and any following panels, are mounted on adjacent, parallel tracks that are approximately shaped like the letter "J". The top panel moves down in a generally straight manner. The second panel moves down parallel to the first panel and then follows the track it is mounted on under the first panel to align with the first panel in a single plane. If there are other panels, the panel will move down and then below the panel that would be immediately above. The deployed panels form a divider in a room or space. In some embodiments, the second panel is lowered first.

The invention allows for a modular use of space. One advantage of this technology is removing the storage of the non-deployed wall or panels from the floor and side of the room into an overhead storage space.

In an office environment, a conference room could be divided into temporary offices for visiting executives or an interview room with an adjacent observation room. The system could be installed in a large, open, office space where smaller offices, half-walled cubicles, conference rooms, interview rooms, and break rooms could be added and removed as needed. In a law-enforcement office with limited space, a temporary interrogation room with attached observation room could be formed from a room that is normally used as a briefing or conference room by deploying a set of panels where an upper panel is made from a one-way mirror material. In case of modular living and work space, the panels could be kept in the ceiling during the work day and lowered to enclose individual rooms for occupancy at night in conjunction with other modular means of changing the furniture in the room automatically.

Another commercial application would be in hotels, hostels, or other lodgings. With this technology, rooms could be made larger and smaller as desired by the guest.

In a domestic environment, this could be used to create a temporary office, room, closet, or bedroom that the home only needs sporadically. This could be used in a micro-home to create smaller, multi-use spaces out of a main living space.

Now referring to the Figures, FIG. 1A is a cross-sectional side elevation view of a system to divide a space in the non-deployed position at 100, that may be used in one embodiment of the present invention. FIG. 1B is a cross-sectional side elevation view of the same system from FIG. 1A in a partially-deployed position at 101. FIG. 1C is a cross-sectional side elevation view of the same system from FIG. 1A in a fully-deployed position at 102.

At 100, first and second track followers 10 are attached to a top and a bottom portion of a first panel 12, respectively. A third track follower 11 is attached to panel 14. At 100, the first panel 12 and the second panel 14 are in a non-deployed state, stored in an overhead space 30 above a ceiling 32 and below upper limit 38. Tracks and track followers have corresponding, mirrored parts on the opposite side of panel 12 and panel 14 that are not visible. The first and second track followers 10 are mounted in a first track 20 and the third track follower 11 is mounted in a second track 22. The first panel 12 and the second panel 14 are capable of dividing space 36 above the floor 34. A gap 35 in the floor 34 corresponds to a tab 16 on the bottom of panel 14. This embodiment might be used in an office space to create small offices as needed.

At 101, the second panel 14 is lowered from its position at 100, the third track follower 11 following the path set by the second track 22 until the second panel 14 reaches the floor 34, where the tab 16 mates with the gap 35, securing panel 14 and preventing panel 14 from swinging on track follower 11 and its corresponding track follower on the opposite side of panel 14. Here, panel 14 is shown as a half-wall divider, as panel 12 is in the ceiling. This is accomplished by lowering only panel 14. This might be used to create half-walled cubicles in an office environment.

At 102, the first panel 12 is lowered from its position at 101 to form a fully deployed divider. This divider has divided the space 36 from floor 34 to ceiling 32. In an alternate embodiment, the first panel 12 can be lowered first with the second panel 14 lowered second, swinging into place. Either option allows the bottom edge of panel 12 and the top edge of panel 14 to touch while being fully deployed, preventing a gap in the wall. In other variations the lower edge of panel 12 and the upper edge of panel 14 have complimentary angled surfaces so that even if panel 12 is deployed first, it will not block panel 14 from fully deploying.

Figure 2:
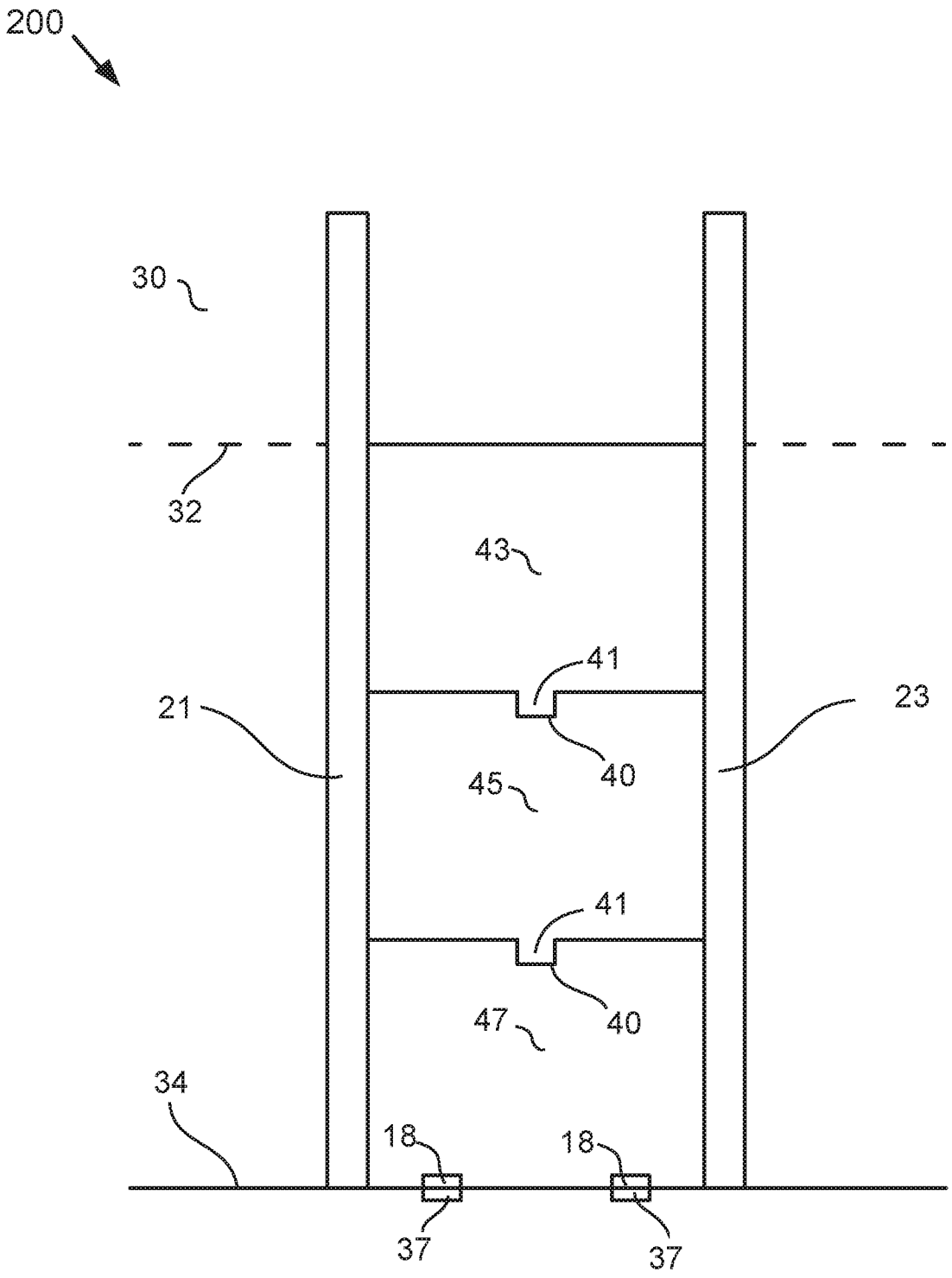
FIG. 2 is a front elevation view of a system to divide a space composed of three panels.

FIG. 2 is a front elevation view of a system in the fully-deployed position at 200, that may be used in one embodiment of the present invention. An opaque composite panel 43 is atop a panel 45 that is made to be a one-way mirror, with another opaque panel 47 below panel 15. The panels are in a fully deployed state, dividing a space from floor 34 to ceiling 32, and leaving overhead space 30 empty. Panel 43, panel 45, and panel 47 are mounted on track set 21 and track set 23. Within track set 21 and track set 23 are three tracks, where panel 13, panel 15, and panel 17 are mounted on respective parallel tracks. Track set 21 and track set 23 are mounted on opposite walls of a space. Panel 47 contains magnets 18 in the bottom edge that align and stick to magnets 37, which are mounted in floor 34. Magnets 18 and magnets 37 act as a locking mechanism for panel 17 and floor 34. Panel 43 and panel 45 have tabs 41 that correspond and mate with slots 40 on panel 45 and panel 47, respectively. The tabs 41 and slots 40 form a locking mechanism. In some iterations, the tabs 41 having a mechanical deadbolt or pins that slide into the side of slots 40 and are only accessible one side of the divider. The size of the tabs is exaggerated for clarity in drawing. The one-way mirror panel 45, paired with the locking mechanism between tabs 41 and slots 40 and the magnets 18 and magnets 37, allow for the space divided to form secure testing or interrogation room on the mirror side with an observation room on the opposite side of the one-way mirror.

Figure 3:
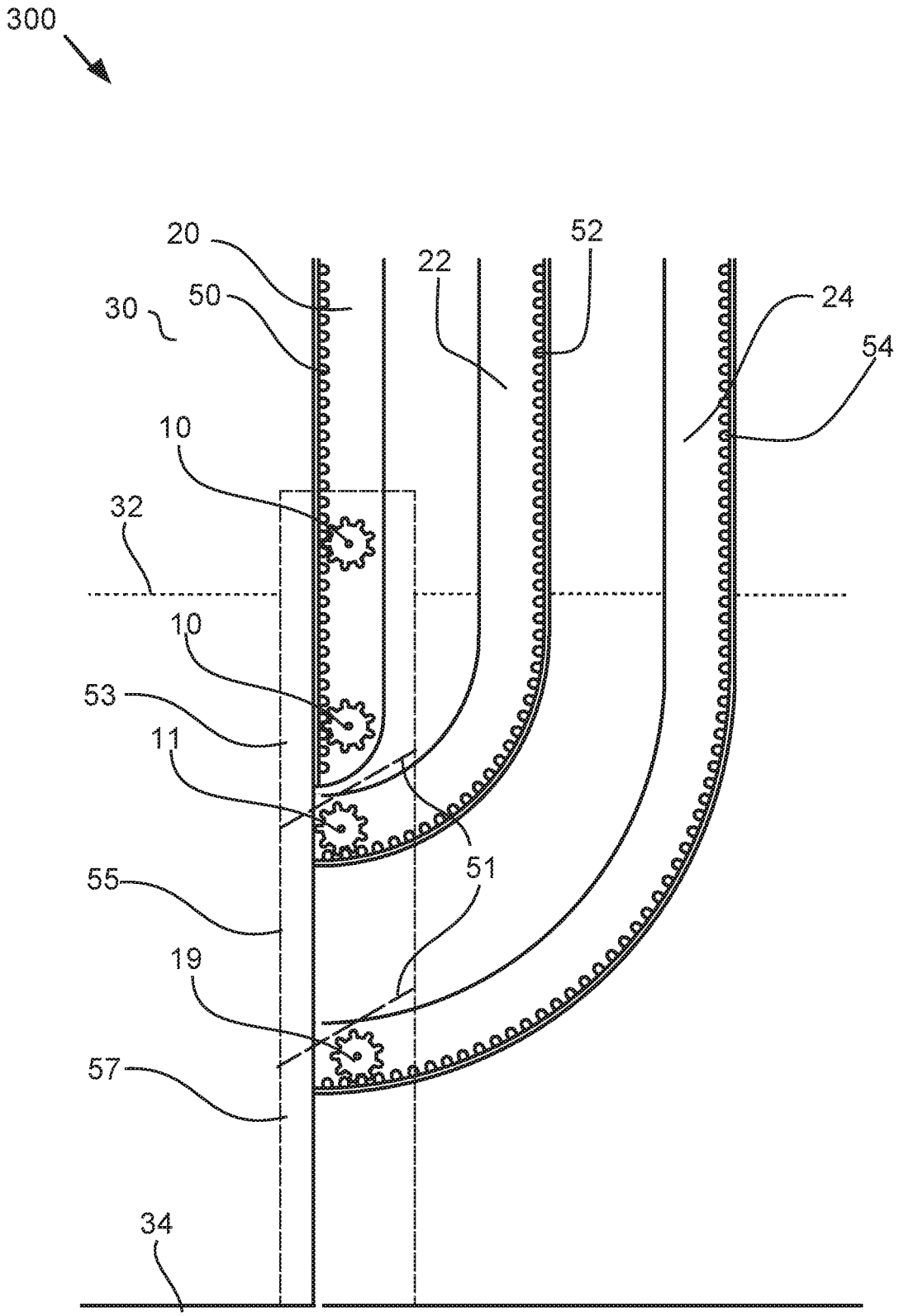
FIG. 3 is a cross-sectional, side elevation view of a system to divide a space composed of three panels.

FIG. 3 is a side elevation view of a system to divide a space in a fully-deployed position at 300, that may be used in one embodiment of the present invention. At 300, track 20, track 22, and track 24 are shown spaced out to allow for thick panel 53, thick panel 55, and thick panel 57, outlined in dashed lines. Track 20, track 22, and track 24 have, respectively, toothed edge 50, toothed edge 52, and toothed edge 54. Edges 51 have gaskets to create a seal between panel 53, panel 55, and panel 57. First and second pinion gear track followers 10 are attached to a top and a bottom portion of a first panel 53. Pinion gear track followers 10 are mounted on track 20, such that pinion gear track followers 10 can climb up and down toothed edge 50. A third pinion gear track follower 11 is attached to panel 55. Pinion gear track follower 11 is mounted on track 22, such that pinion gear track followers 11 can climb up and down toothed edge 52. A fourth pinion gear track follower 19 is attached to panel 57. Pinion gear track follower 19 is mounted on track 22, such that pinion gear track follower 19 can climb up and down toothed edge 54. Pinion gear track followers have built-in electric motors to provide locomotion. Panel 53, panel 55, and panel 57 contain rechargeable batteries that power the electric motors in, respectively, pinion gear track followers 10, pinion gear track follower 11, and pinion gear track follower 19. The shape of the edges 51 necessitates that the divider is deployed with panel 55 before panel 57. Storage of the panels into overhead space occurs in reverse order, with panel 57 first and panel 55 second. Panel 53 can be placed before, simultaneously, or after panel 55 and panel 57. Panel 53 does not completely leave the overhead space 30, allowing it to create a better seal between panel 53 and ceiling 32. The thickness of panel 57 in contact with the floor 34 combined with the single-track follower on the side keeps the panel stable.

Figure 4:
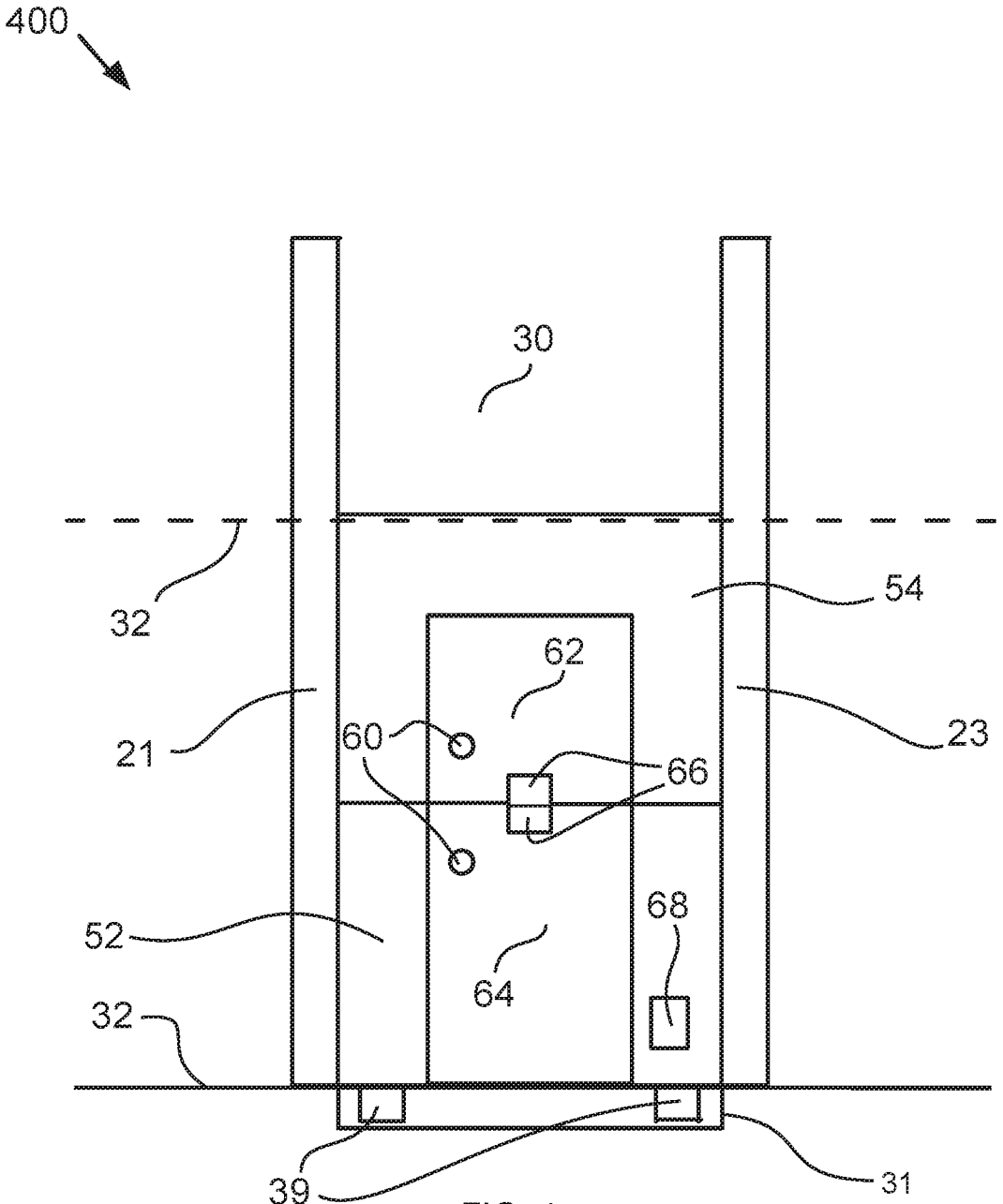
FIG. 4 is a front elevation view of a system to divide a space with a door in the divider.

FIG. 4 is a front elevation view of a system to divide a space with a door in the divider at 400. Top panel 54 and bottom panel 52 are in a deployed position, becoming a divider with a door. Top panel 54 and bottom panel 52 are mounted on track set 21 and track set 23. Within track set 21 and track set 23 are two tracks each, where panel 52 and panel 54 are mounted on respective parallel tracks of a similar type as those shown in FIG. 1. Upper half-door 62 and lower half-door 64 have latching mechanisms 60 used to keep the upper half-door 62 and lower half-door 64 closed. Both upper half-door 62 and lower half-door 64 can be opened separately or together. If desired, locking mechanism 66 can be used to lock both upper half-door 62 and lower half-door 64 together to assist in opening and closing the combined half-doors. Pet door 68 is a cut-out in panel 52 to allow small animals, drones, and similar through panel 53. An insert may be placed in pet door 68 to ensure privacy. Panel 52 is reinforced with a ferric metal. Magnets 39 mounted in floor 32 stick to the metal reinforcement in panel 52, acting as a locking mechanism, preventing panel 52 from being lifted by mistake. When fully deployed, panel 52 slides into slot 31 in floor 32 to allow reinforcement all the way around the base of the door without creating a trip hazard while passing through the door. While fully deployed, the top of panel 54 remains above the plane of the ceiling 32 into the overhead space 30 to ensure there are no gaps at the top of the wall.

Figure 5A:
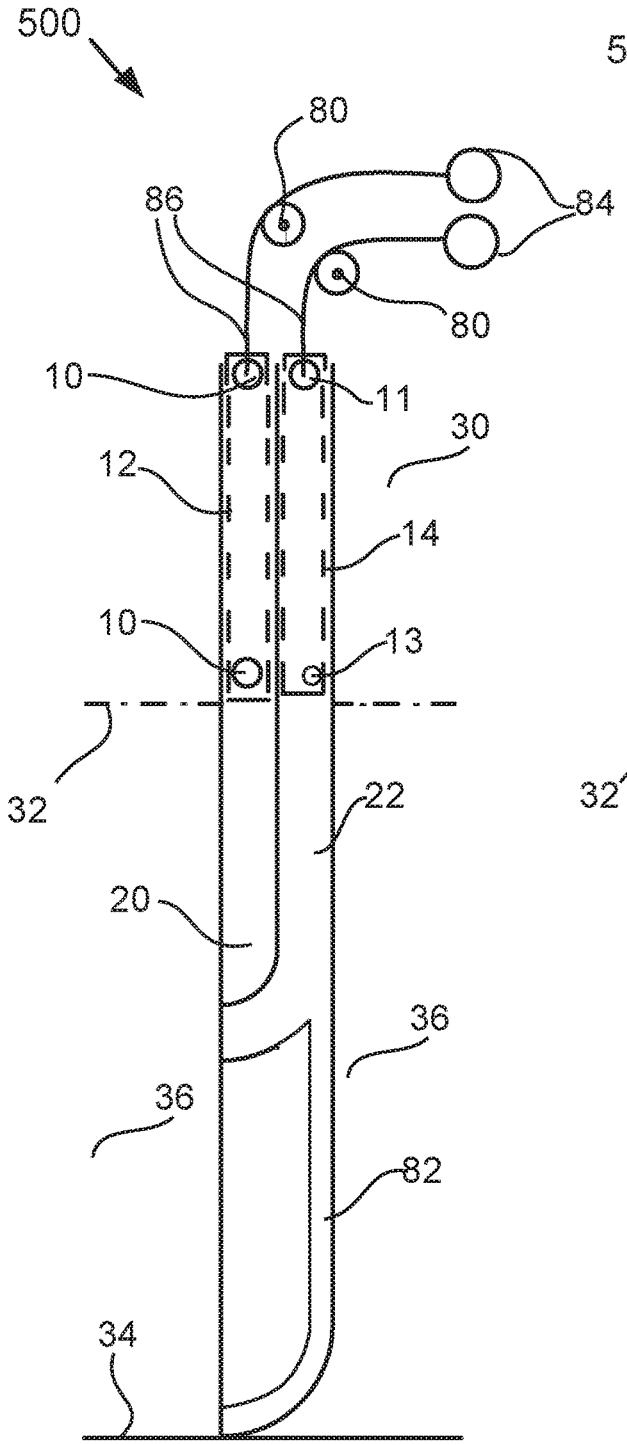
FIGS. 5A and 5B are cross-sectional, side elevation views of a system to divide a space in retracted and fully-deployed states.
Figure 5B:
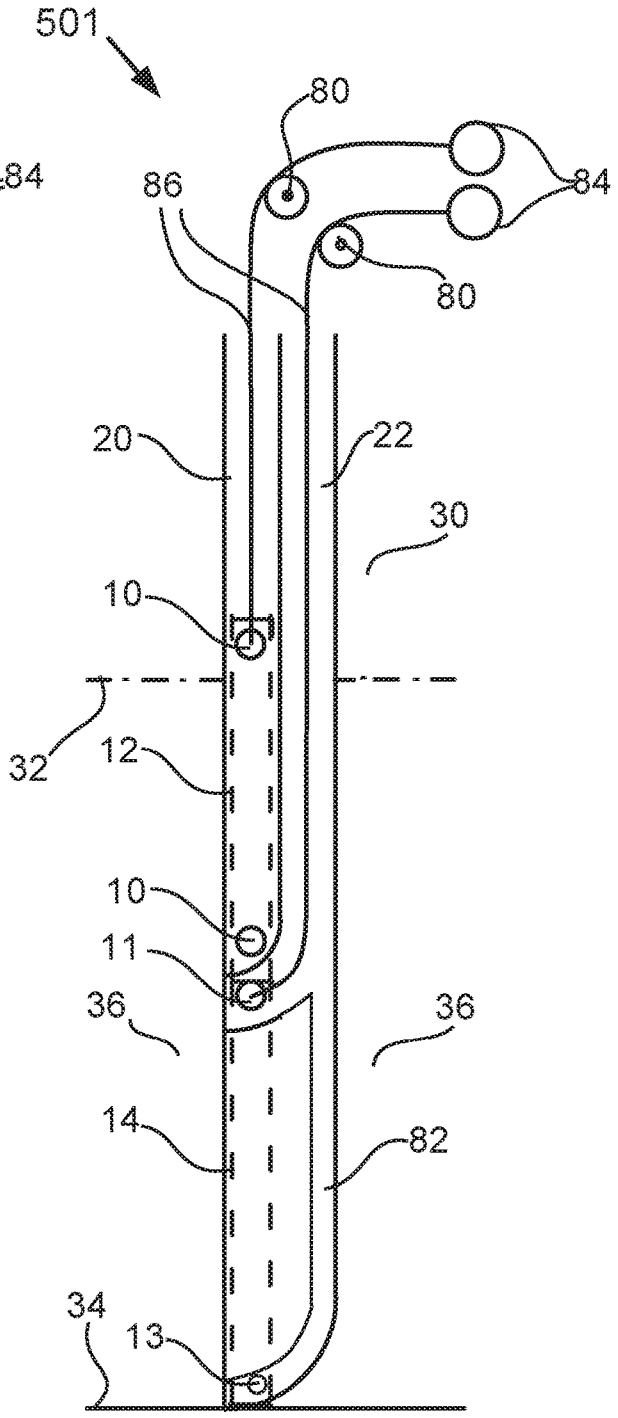

FIG. 5A is a cross-sectional, side, elevation view of a system to divide a space in the non-deployed position at 500, that may be used in one embodiment of the present invention. FIG. 5B is a cross-sectional, side, elevation view of the same system from FIG. 5A in a fully deployed position at 501.

At 500, first and second track followers 10 are attached to a top and a bottom portion of a first panel 12, respectively. A third track follower 11 is attached adjacent to the top of panel 14. A smaller track follower 13 is attached adjacent to the bottom and left portion of panel 14. The first panel 12 and the second panel 14 are in a non-deployed state and are being stored in an overhead space 30 above a ceiling 32 and below upper limit 38. Tracks and track followers have corresponding, mirrored parts on the opposite side of panel 12 and panel 14 that are not visible. The first and second track followers 10 are mounted in a first track 20 and the third track follower 11 and fourth track follower 13 are mounted in a second track 22. When panel 14 descends, track follower 13 will follow into sub-track 82. The first panel 12 and the second panel 14 are capable of dividing space 36 above the floor 34. Panel 12 and panel 14 are raised and lowered by means of winches 84 and braided cables 86. Braided cables are attached to the upper track follower 10 on panel 12 and track follower 11 on panel 14. Braided cables 86 move along pulleys 80 to translate the direction of the pull of the winches 84 from horizontal to vertical.

At 501, panel 12 and panel 14 are lowered from their position at 500 to form a fully deployed divider. This divider has divided the space 36 from floor 34 to ceiling 32. A method of reaching the fully deployed state is to start lowering panel 14 down, before starting panel 12, early enough that it will be in place before panel 12 reaches a fully lowered position and blocking panel 14 from reaching a fully lowered state. This allows the bottom edge of panel 12 and the top edge of panel 14 to touch while being fully deployed, preventing a gap in the divider. Track follower 13 travels along sub-track 82 to maintain the vertical orientation of panel 14 while panel 14 is being deployed, while deployed, and while panel 14 is retracting. Winches 84 pull and release braided cables 86 to, respectively, raise and lower panel 12 and panel 14 into and out of position. Having separate winches 84 for panel 12 and panel 14 allows for independent movement of said panels. Independent movement of panel 12 and panel 14 allows for panel 14 to be lowered separately to form a half-wall divider.

Figure 6:
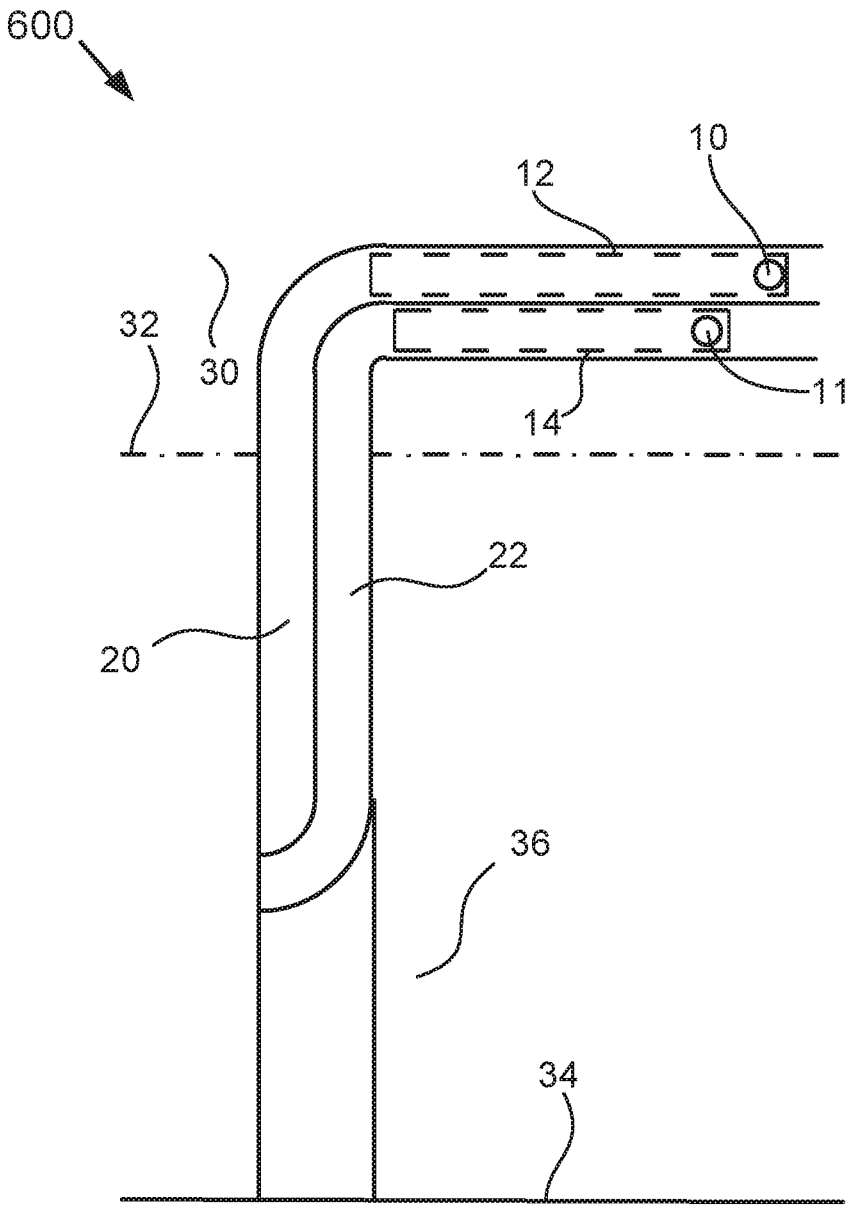
FIG. 6 is a cross-sectional side elevation view of a system to divide a space in a retracted state.

FIG. 6 is a cross-sectional side elevation view of a system to divide a space in a non-deployed state at 600, that may be used in one embodiment of the present invention. Panel 12 and panel 14 are stored horizontally in the overhead space 30. This is accomplished by shelves built into track 20 and track 22. In the overhead space 30, the horizontal section of track 20 and track 22 extend into the page and link to the mirrored tracks on the other side of panel 12 and panel 14, forming shelves. Panel 12 must be stored first, allowing the angling of panel 14 as panel 14 move into a shelf.

Figure 7A:
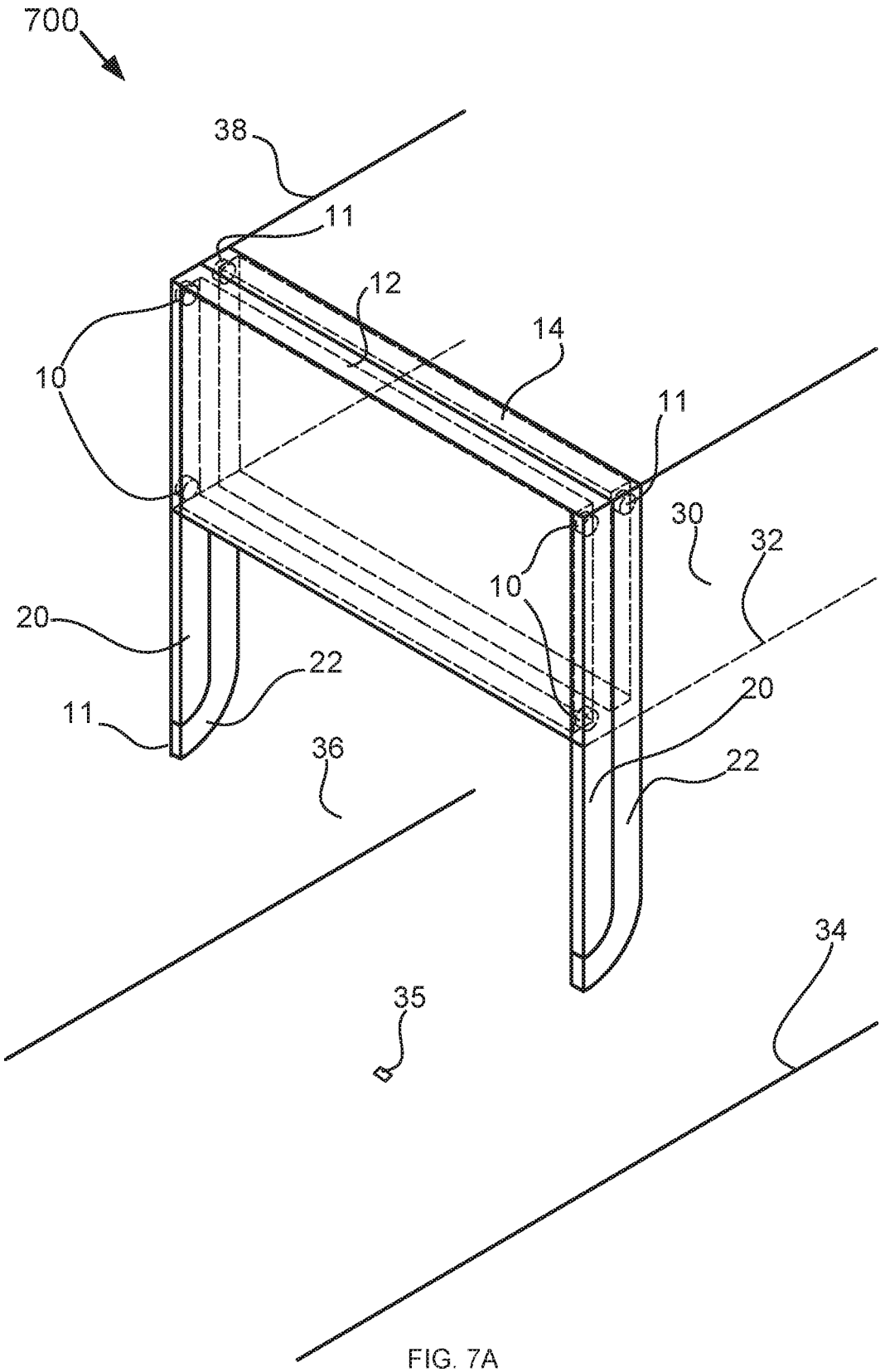
FIGS. 7A-7C are an isometric top, front views of the system in FIG. 1B.
Figure 7B:
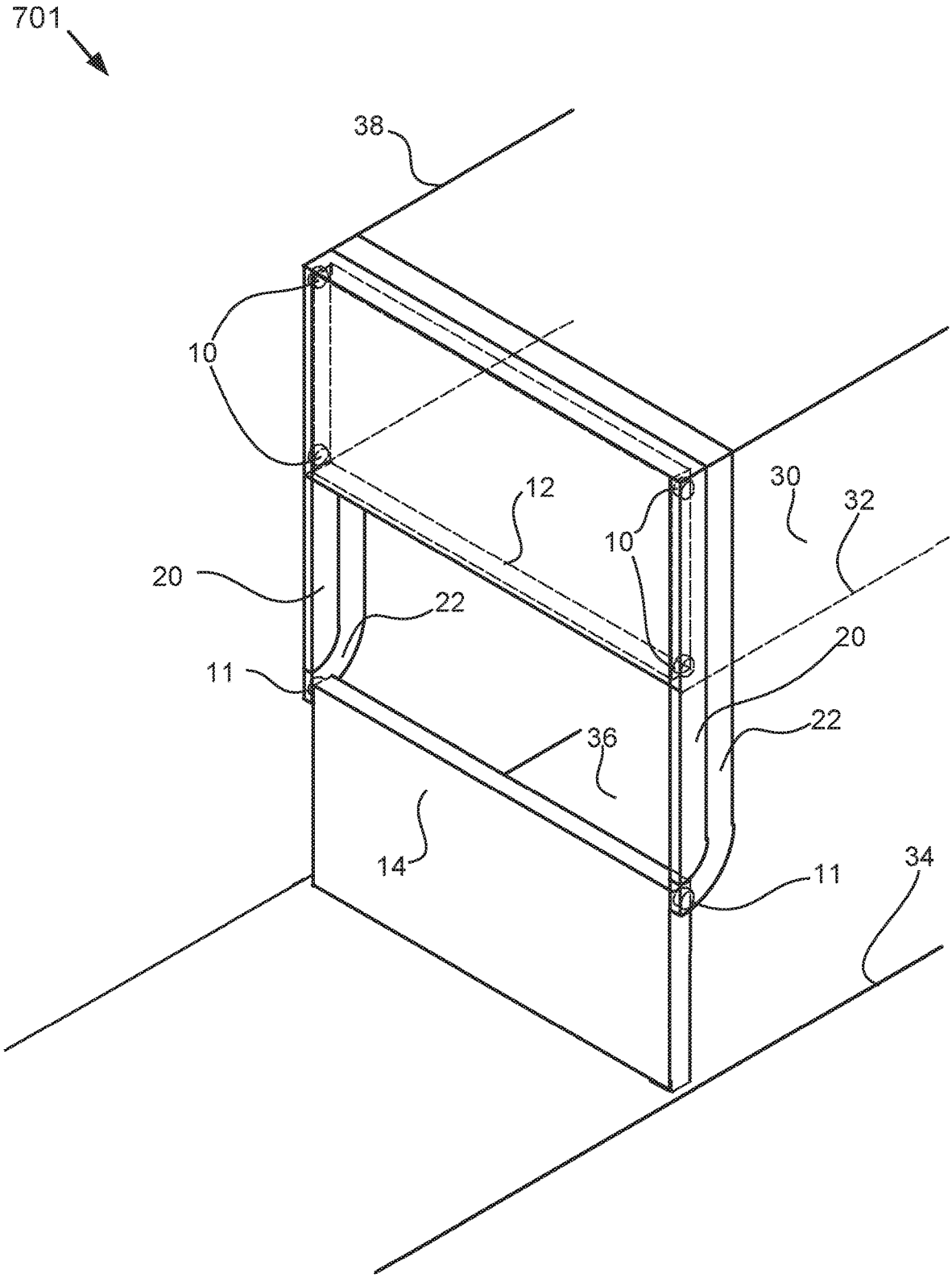
Figure 7C:
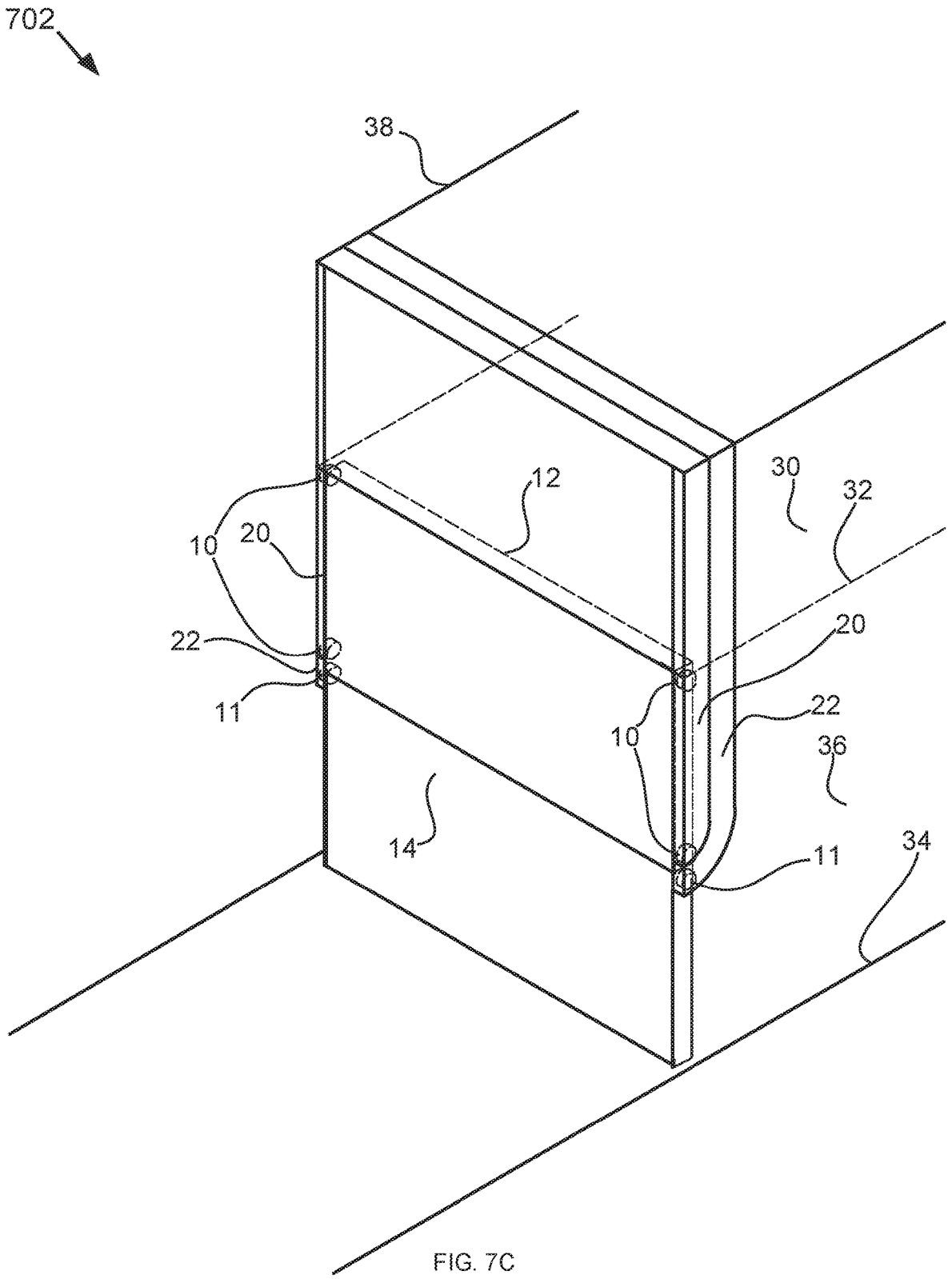

FIGS. 7A-C are isometric top, front side elevation views of the same system from FIGS. 1A-C, respectively.

At 700, an isometric view of the system in FIG. 1B, is shown. Track followers 10 are attached to panel 12 and mounted on tracks 20. Track followers 11 are attached to panel 14 and mounted on track 11. Panel 12 and panel 14 are in a non-deployed state and are being stored in an overhead space 30 above a ceiling 32 and below upper limit 38. When the second panel 14 is lowered, the track followers 11 follow the path set by tracks 22 until the bottom edge of panel 14 reaches the floor 34. A tab on the bottom of panel 14, which is not visible in the drawing, mates with a gap 35 in the floor, securing panel 14 and preventing panel 14 from swinging on track followers 11. As shown, tracks 20 and tracks 22 are ceiling mounted, allowing panel 12 and panel 14 are deployable in the middle of a space, without permanent walls adjacent. This might be used to create half-walled cubicles or full walled offices in an open office environment by mounting multiple systems around a rectangle.

At 701, panel 14 is lowered from its position at 700, track followers 11 following the path set by the tracks 22. When panel 14 reaches the floor 34, where the unseen tab mates with gap 35, visible in FIG. 7A. Here, panel 14 is shown as a half-wall divider, as panel 12 remains in the ceiling.

At 702, panel 12 is lowered from its position at 701, track followers 10 following the path set by the tracks 20, until the bottom edge of panel 12 touches the top edge of panel 14. Panel 12 and panel 14 form a divider from floor 34 to ceiling 32, leaving overhead space 30 empty. The fully deployed divider could be the wall of a temporary office in an open office.

The invention has been described with reference to various specific and preferred embodiments and techniques. Nevertheless, it is understood that many variations and modifications may be made while remaining within the spirit and scope of the invention.

What is claimed is:

1. A system for reversibly dividing a space comprising:

a first panel with a first track follower and a second track follower, each attached to opposite sides of the first panel;

a second panel with a third track follower and a fourth track follower, each attached to opposite sides of the second panel;

a first track and a second track, each on opposite sides of the space to be divided, each running generally straight and generally vertical and each having a top at a point overhead and a bottom at a point part-way to a floor of the space;

a third track and a fourth track, each having a vertical portion that is adjacent and runs parallel to the first track and the second track, respectively, and each having a curved portion extending below and across the bottom of the first track and the bottom of the second track, respectively;

wherein the first and second panel can be stored in an overhead position;

wherein, as the first panel is lowered, the first track follower rides in the first track and the second track follower rides in the second track, until the first and second track followers reach the bottoms of the first and second tracks, respectively, thus allowing the first panel, when lowered, to divide an upper portion of the space;

wherein, as the second panel is lowered, the third track follower rides in the third track and the fourth track follower rides in the fourth track, wherein the third track follower and the fourth track follower ride in a generally vertical path, parallel to the first track and the second track, respectively, until the third track follower and the fourth track follower reach the curved portion of the third track and the fourth track, respectively, whereupon the third track follower and the fourth track follower move below and across the bottom of the first track and the bottom of the second track, respectively, thus allowing the second panel to be aligned with the first panel and divide a lower portion of the space, and wherein, when deployed, the first panel and the second panel form a divider; and wherein both the third track and fourth track are approximately J-shaped.

2. The invention of claim 1 wherein the space has a ceiling and wherein the overhead position is above the ceiling.

3. The invention of claim 1 wherein the first panel further comprises a fifth and sixth track follower, each attached to an opposite side of the first panel and each attached adjacent a top edge of the first panel.

4. The invention of claim 1 wherein the second panel comprises a seventh track follower and an eighth track follower smaller than the third and fourth track followers, each attached to an opposite side of the second panel and each attached adjacent a bottom edge of the second panel, and wherein the third and fourth tracks have a first branching track and a second branching track off a bottom of the curved portion of the third and fourth tracks that is smaller than the third and fourth tracks such that the seventh and eight track followers follow the first and second branching tracks and the third and fourth track followers are prevented from following the first and second branching tracks, and wherein the first and second branching tracks each comprise a curved bottom portion paralleling the curved portion of the third and fourth tracks, respectively.

5. The invention of claim 1, wherein each of the first, second, third and fourth tracks comprises a rack of teeth and wherein the first, second, third and fourth track followers comprise driven pinion gears, configured to walk along the track of the respective tracks, to thereby raise and lower the first and second panels.

6. The invention of claim 1, wherein the top portion of the second panel and the bottom portion of the first panel touch along an edge.

7. The invention of claim 1, further comprising:

a first line and a second line each attached to the opposite sides of a top edge of the first panel and configured to raise and lower the first panel; and a third line and a fourth line attached to the opposite sides of the top edge of the second panel and configured to raise and lower the second panel.

8. The invention of claim 7, wherein the first line and the second line are attached to at least one first lifting device and wherein the third line and the fourth line are attached to at least one second lifting device.

9. The invention of claim 1, wherein a bottom portion of the second panel attaches magnetically to a floor of the space.

10. The invention of claim 1, wherein a bottom portion of the second panel is shaped to interlock with a gap in a floor of the space.

11. The invention of claim 1, wherein the first panel and the second panel are composed of materials selected from the group consisting of glass, composites, plastics, mirrors, metal, and combinations thereof.

12. The invention of claim 1, wherein the first panel returns into the overhead space or does not lower, leaving the second panel as a half-wall divider.

13. The invention of claim 1, further comprising sound dampeners on and around a perimeter of the first and second panel configured to deploy when the divider is deployed.

14. The invention of claim 1, further comprising a plurality of tracks similarly shaped to and paralleling the third and fourth tracks, allowing for a corresponding plurality of panels to divide further lower portions of the space.

15. The invention of claim 1, further comprising a locking mechanism on a bottom portion of the first panel and a top portion of the second panel configured to lock the first and second panels together.

16. The invention of claim 1, further comprising gaskets between the first and the second panels.

17. The invention of claim 1, wherein an upper portion of the first, second, third, and fourth tracks form upper curved portions in the overhead space.

18. The invention of claim 1, further comprising small cutouts or doors in the panels to allow small animals or objects to pass through.

19. The invention of claim 1, further comprising panels with built-in doors large enough for people to pass through.

20. The invention of claim 19, further comprising a slot in the floor sized to match with a bottom of the second panel, allowing a bottom of the door to be flush with the floor while still having reinforcement from the second panel.

* * * * *